US006814425B2

(12) United States Patent
Mott et al.

(10) Patent No.: US 6,814,425 B2
(45) Date of Patent: Nov. 9, 2004

(54) DROPLET PLACEMENT ONTO SURFACES

(75) Inventors: James A. Mott, San Diego, CA (US); Mark A. Van Veen, Cardiff, CA (US); Melissa Lee, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/121,352

(22) Filed: Apr. 12, 2002

(65) Prior Publication Data

US 2003/0189617 A1 Oct. 9, 2003

(51) Int. Cl.[7] ..... B41J 2/145
(52) U.S. Cl. ..... 347/40; 347/12
(58) Field of Search ..... 347/12, 37, 40, 347/41

(56) References Cited

U.S. PATENT DOCUMENTS

| | | | | | |
|---|---|---|---|---|---|
| 4,707,704 | A | | 11/1987 | Allen et al. | 346/24 |
| 5,072,240 | A | * | 12/1991 | Miyazawa et al. | 347/22 |
| 5,790,150 | A | | 8/1998 | Lidke et al. | 347/41 |
| 5,889,534 | A | | 3/1999 | Johnson | 347/19 |
| 6,332,665 | B1 | * | 12/2001 | Mantell et al. | 347/37 |
| 6,394,577 | B1 | * | 5/2002 | Wen et al. | 347/37 |
| 6,435,652 | B1 | * | 8/2002 | Rezanka | 347/42 |
| 6,502,920 | B1 | * | 1/2003 | Anderson et al. | 347/40 |

FOREIGN PATENT DOCUMENTS

| | | | | |
|---|---|---|---|---|
| EP | 0517520 A2 | * | 9/1992 | B41J/2/205 |
| EP | 0517521 A2 | * | 9/1992 | B41J/2/205 |
| EP | 0589669 A1 | * | 3/1994 | B41J/2/205 |
| JP | 62216141 | * | 3/1989 | 347/37 |
| JP | 04328160 | * | 6/1994 | 347/37 |

* cited by examiner

*Primary Examiner*—Thinh Nguyen
*Assistant Examiner*—Julian D. Huffman

(57) ABSTRACT

A method and apparatus for placing fluid droplets onto a surface in which at least one of a group of nozzles is substantially aligned with a first of parallel line segments on the surface moving in a first direction relative to the nozzles; at least one droplet is ejected from the first nozzle onto a target on the first segment; the group of nozzles is moved in a second direction having a component orthogonal to the first direction to respectively align first and second nozzles in the group with a second segment and with the first segment; the and fluid droplets are ejected from the nozzles onto targets on the segments, the center to center spacing of the targets along the segments equaling one or a multiple of the center to center spacing of the nozzles orthogonal to the segments.

11 Claims, 8 Drawing Sheets

DROPLET PLACEMENT ONTO SURFACES

BACKGROUND OF THE INVENTION

Techniques for printing a pattern or image comprised of a plurality of individual targets or pixels arranged in a grid involve the use of printheads, often referred to in the art as pens. The printheads typically are moved along a scan axis in a forward scan direction, then after stopping, moved in a reverse scan direction opposite to the forward scan direction. In between at least some of the movements along the scan axis, the print medium is typically advanced in a media advance direction whose axis is substantially orthogonal to the scan axis. Printheads typically have a plurality of ink ejection elements, each of which controllably ejects ink through a corresponding nozzle on the surface of the printhead and onto the print medium. One characteristic of a printhead is its effective nozzle density, expressed for example in printhead nozzles per inch (pnpi), which can be greater than or equal to the required print density expressed in printed dots per inch (dpi).

SUMMARY OF THE INVENTION

The present invention therefore provides a method and apparatus for placing fluid droplets onto a surface in which at least one of a group of nozzles is substantially aligned with a first of parallel line segments on a surface moving in a first direction relative to said nozzles; at least one droplet is ejected from said first nozzle onto a target on said first segment; said group of nozzles is moved relative to said surface in a second direction having a component orthogonal to said first direction and another component parallel to said first direction to respectively align first and second nozzles in said group with a second segment and with said first segment; and droplets are ejected from said nozzles onto targets on said segments, the center to center spacing of said targets along said segments equaling one or a multiple of the center to center spacing of said nozzles orthogonal to said segments.

DETAILED DESCRIPTION

Without limitation and by way of example only, this disclosure will primarily refer to inkjet printing of a pattern or image onto media supported on the outside surface of a rotating cylinder or drum. The ink droplet pattern may also be placed directly onto the surface of the drum itself as in offset printing or, with appropriate structural modification, onto the inside surface of the drum or media supported therein. The media onto which printing takes place may include paper, fabric or any other media to be printed. The droplet placement device may comprise one or more thermal or piezoelectric inkjet printheads or other functionally equivalent types of fluid droplet ejectors. Such devices have a maximum sustainable firing rate which significantly limits the speed of droplet placement.

Figure 1:
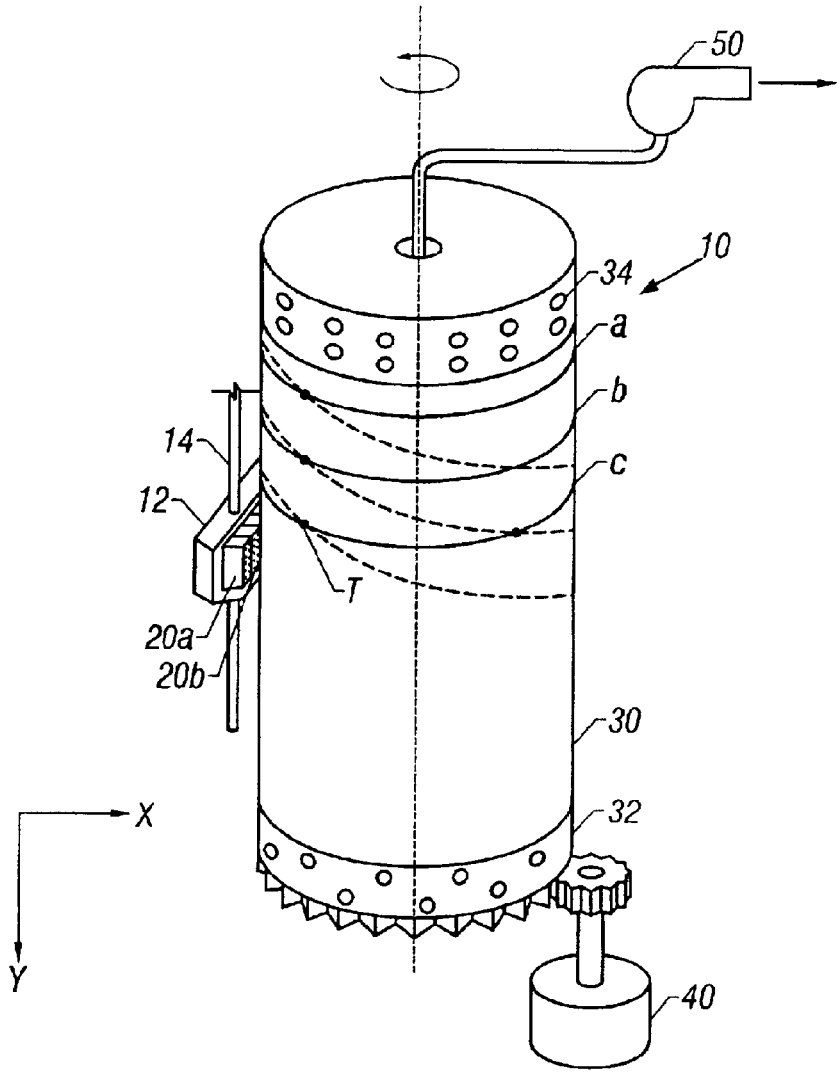
FIG. 1 is a schematic view of an embodiment of the present invention comprising a rotary drum inkjet printer.

FIG. 1 depicts a rotary inkjet printing mechanism 10 comprised of a linearly movable printhead carriage 12 supported on a longitudinally extending guide 14. A plurality of inkjet printheads 20*a*, 20*b*, etc.are mounted in any suitable fashion on the carriage 12 in printing proximity to a rotary member depicted in the form of a cylindrical drum 30 having an exterior arcuate surface 32 and axis of rotation parallel to the direction off movement of the printhead carriage 12. Paper, vellum, fabric or other media on which printing is to take place may be, in the embodiment depicted, supported on the exterior surface 32 of the drum 30 in any suitable fashion. By way of example only, the wall of the drum 30 may be perforated as at 34, the interior of the drum being subjected to vacuum pressure by any suitable known means, such as an exemplary vacuum pump 50, to retain the media on the exterior surface 32 of the drum during printing. An exemplary motor and transmission mechanism 40 is schematically shown for rotating the drum 30 about its central axis.

Figure 2A:
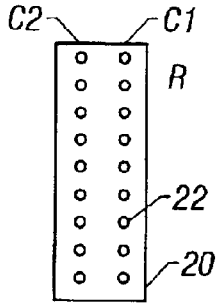
FIGS. 2*a* and 2*b* are schematic views of an embodiment of printheads usable with the printer of FIG. 1, each depicted, in this example, as having two groups or columns of aligned nozzles, the nozzles in FIG. 2*a* also being aligned in rows whereas the nozzles in FIG. 2*b* are staggered.
Figure 2B:
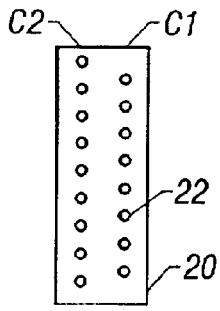

As seen in FIGS. 2*a* and 2*b*, the inkjet printheads 20 supported on the carriage 12 each include an array of inkjet ejection elements having orifices or nozzles 22 through which ink droplets are ejected toward the drum 30. In FIG. 2*a* the nozzles 22 are aligned in two parallel columns C1 and C2 oriented in the direction Y of printhead carriage movement. The nozzles in the two columns each have the same center to center spacing in the Y directin. The columns of nozzles in FIGS. 2*a* and 2*b* are spaced apart in the X direction the same distance. An alternative arrangement is shown in FIG. 2*b* in which the nozzles 22 are also grouped into columns C1, C2 oriented in the Y direction but in which the nozzles 22 in FIG. 2*b* are staggered in the Y direction such that the nozzles 22 in a first column C1 are placed between, in the Y direction, the nozzles 22 in the other column C2. The columns and nozzles are thus staggered in the Y direction so that the individual nozzles 22, apart from the lower end nozzle 22 in column C1 and the upper end nozzle 22 in column C2, are aligned in rows R which extend in the direction of arcuate movement X of the drum surface 32. It will be understood by those skilled in the art that the invention is not limited to the exemplary arrangements of nozzles 22 shown in FIGS. 2*a* and 2*b*. The staggered column arrangement of FIG. 2*a* provides an effective printhead nozzle density, referred for convenience in terms of printhead nozzles per inch (pnpi) in the Y direction which is equal to the density in nozzles per inch (npi) of the nozzles in a single column, i.e. pnpi=npi. In comparison, the staggered nozzle spacing in FIG. 2*b* provides an effective printhead nozzle density (pnpi) in the Y direction which is twice the density of nozzles in each column (pnpi=2npi). For example, if the nozzles 22 are spaced in the Y direction to provide a nozzle density of 600 npi, the effective printhead nozzle density pnpi of FIG. 2*a* is 600 npi, whereas the effective printhead nozzle density pnpi of FIG. 2*b* is 1200 npi.

The printheads 20 are preferably supported on the carriage 12 such that the columns of printhead nozzles 22 are aligned in the Y direction parallel to the axis of rotation of the drum 30 and orthogonal to the direction X, of a line of targets or pixels to be printed. Although alignment of the columns of nozzles 22 in the Y direction as shown in the drawings is typical, such is not essential. Continuous timed linear movement of the carriage 12 (and thus the associated printheads 20) at a preferably constant speed through the zone in which printing takes place, synchronized with a preferably constant speed of rotation of the drum 30, allows printing on successive circular line segments of targets as the individual nozzles 22 each trace over continuous helical lines on the arcuate surface of the drum 30 as seen in FIG. 1 where the target line segments are represented in solid lines a, b, c and the helical traces are represented by the dashed lines. One or more fluid droplets may be deposited by one or more nozzles 22 onto targets T at the intersections of the solid and dashed lines during successive revolutions of the drum 30.

Although the carriage 12 and printheads 20 are shown in the drawings on a guide 14 which is oriented in the Y direction parallel to the axis of rotation of the drum 30, those skilled in the art will understand that carriage support guides 14 of other configuration can be provided for moving the carriage 12 and printheads 20 in proximity to the rotating drum 30, the only constraint being that the carriage 12 and printheads 20 are required to move in synchronization with and relative to the drum 30 in a direction which has a Y component parallel to the axis of the drum 30. A single scan of the carriage 12 and printhead or printheads 20 relative to the drum 30 comprises unidirectional movement of the carriage and printheads from one end to the other on the guide or guides 14 through the printing zone. The drum 30 may rotate one or more times during each scan. Multi-scanning involves movement of the carriage 12 and printhead(s) 20 more than once past the printing zone.

It will be recognized by those skilled in the art that the geometrical relationships which exist between npi, pnpi and dpi are based on the architecture of the printheads which will be employed and the desired printed resolution and will be selected before detailed design of a specific embodiment.

Figure 3:
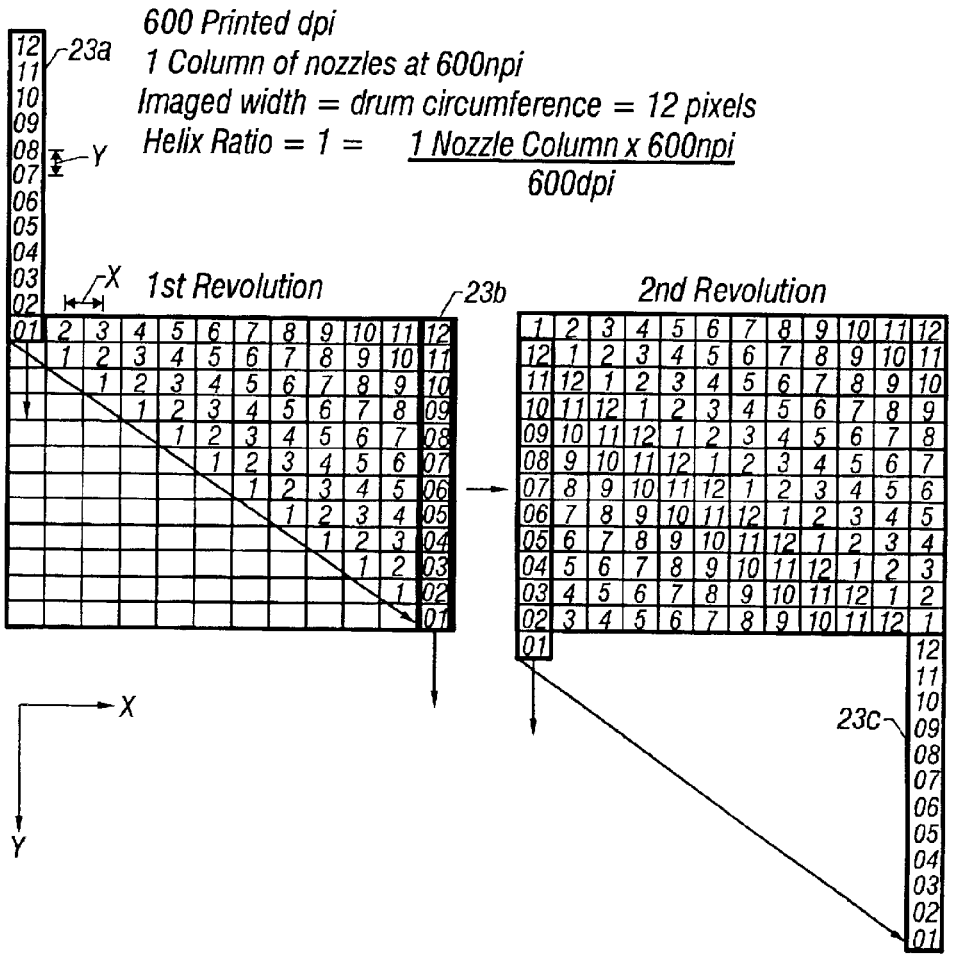
FIG. 3 is a print mask according to an embodiment of the invention indicative of which ones of a single column of nozzles of FIG. 2 will deposit fluid drops on the indicated row and column target location of the drum in a single pass during two rotations of the drum.

Turning now to FIG. 3, a printhead 20 having a single column shown with 12 (substantially more will be used in practice) consecutively numbered nozzles 22 for printing a pattern comprised of 144 targets arranged in a rectangular grid. This figure shows a flattened layout assuming a drum circumference divided into 12 targets or pixels; substantially more will be used in practice. In this example, each target is spaced at a center-to-center distance X equal to the center-to-center spacing Y of the nozzles 22 in the column so that fluid drops for the entire print pattern may be deposited in a single downward pass of the nozzles 22 relative to the drum 30. In this example, the linear speed of movement of the nozzles 22 in the direction Y is equal to the tangential speed in the direction X of a target on a surface 32 of the drum 30, and full density image printing requires each nozzle 22 to repeatedly eject ink droplets at the maximum rated firing frequency of each nozzle. The numbering in the pixels depicts the number of the nozzle 22 which has fired ink into the pixel and the starting 23*a*, intermediate 23*b* and finished locations 23*c* of the printhead 20 relative to the image are each shown. Nozzle number 1 prints a diagonal line of pixels commencing with a first pixel at the top of the first column of targets starting at the left side of the figure. As the printhead moves downwardly during a scan, nozzle 1 drops one target row as nozzle 2 drops to position for printing into the top row of targets and continues printing into targets in the diagonal pixel line numbered 2, etc. until the printhead 20 reaches an intermediate position at which time the drum 30 has completed one revolution and a generally triangular area at the upper right of the image has been printed. During a second revolution of the drum 30, continued downward movement of the printhead 20 causes the upper nozzles 12, 11, 10, etc., to complete printing onto the targets comprising the lower left triangular portion of the image. It will be appreciated by those skilled in the art that such an arrangement, while operable, requires a number of revolutions of the drum equal to n swaths+1 where a swath is the printable height of a given printhead. For this particular example, two revolutions of the drum are required to complete printing and no safety factor is provided in case of inoperable or defective nozzles. The FIG. 3 arrangement is said to have a rise/run pattern or helix ratio of 1:1, in other words, effective spacing or density pnpi of the nozzles in the Y direction in this example equals the number of target pixels on the arcuate surface of the drum in the X direction and the speed, in the Y direction, of the printhead(s) 20 will be the same as the speed, in the X direction, of a target pixel on the surface of the drum 30. In a more general case as will be explained with reference to FIG. 8 in which more than one nozzle may fire into a single target pixel, the helix ratio equals (the number of columns of nozzles×the nozzle density in the columns expressed in npi)/(print resolution in dpi×the number of drops fired onto each pixel).

Figure 4:
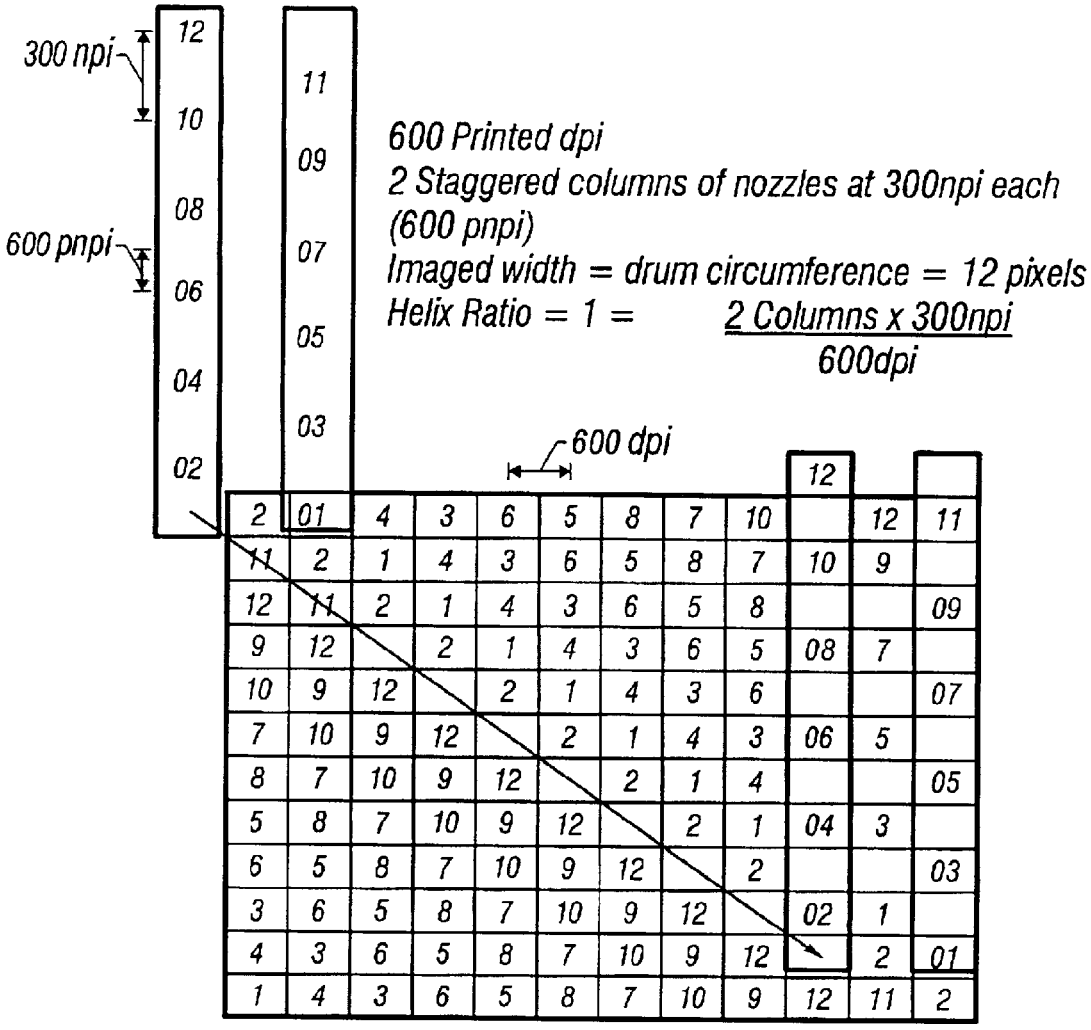
FIG. 4 is a printed pattern or mask according to an embodiment of the invention which may be produced by nozzles in two columns of staggered nozzles depositing fluid drops on the indicated row and column target locations of the drum in a single pass during two rotations of the drum.

FIG. 4 depicts a more efficient arrangement for printing a pattern comprised of the same number of targets using multiple columns of staggered nozzles. This example also comprises targets arranged in 12 columns and rows. The nozzle arrangement comprises two columns of nozzles 22, which may be on the same or different printheads 20, having a center to center column spacing in the X direction which is twice the center to center spacing in the X direction of the targets. The nozzle spacing in each column may be 300 npi for an effective pnpi of 600, while the target spacing is 600 dpi. The nozzles 22 are arranged as shown in FIG. 2*b* in which the individual nozzles 22 are staggered in the Y direction by one-half the height of a target from one column to the next to provide an effective printhead nozzle density pnpi (in the Y direction) which is twice the npi spacing or density of the nozzles in each column. For example, this arrangement allows the use of less expensive printheads having nozzles in each column spaced in the Y direction at, e.g., 300 npi to achieve an effective printhead nozzle density pnpi and resulting resolution of 600 dpi. This results in a helix ratio of 1:1 as in FIG. 3. As in the particular example of FIG. 3, two revolutions of the drum 30 are required to complete printing of a square pattern or image, while images of greater length in the Y direction would require n+1 revolutions where n is the swath height of the printhead(s). As referred to herein, the term "swath height" means the distance, in the Y direction, from the lowest to the highest nozzle on the printhead. If a desired print density of, say 1200 dpi is desired, this can be achieved by a printhead having two staggered columns of nozzles spaced at 600 npi or by a printhead having a single column of nozzles spaced at 1200 npi.

Figure 5:
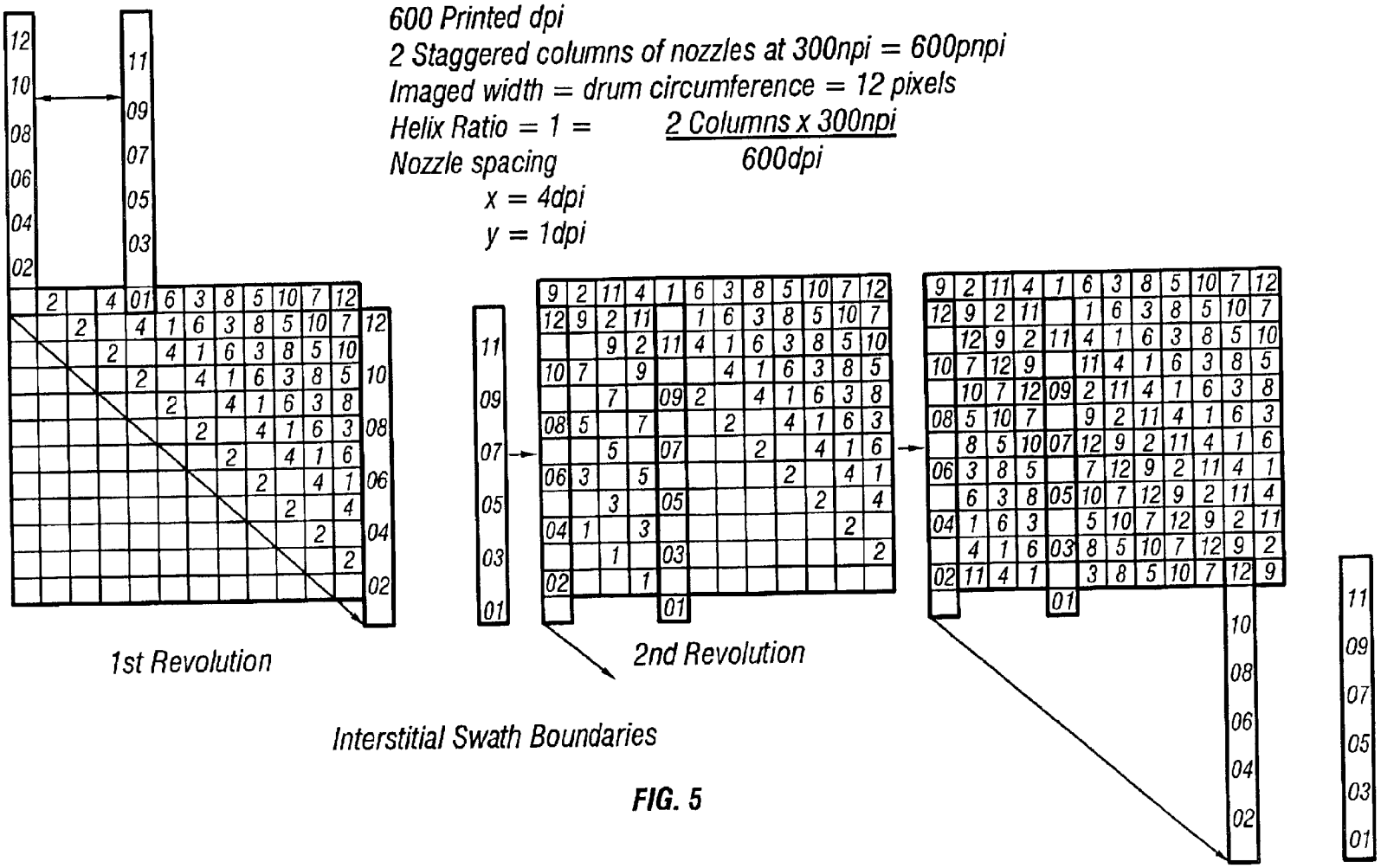
FIG. 5 is a printed pattern or mask according to an embodiment of the invention which may be produced by nozzles in two columns of staggered nozzles in a single pass, the columns being spaced at a selected distance to provide an intersticial boundary.

FIG. 5 illustrates an arrangement similar to FIG. 4 in which the nozzles 22 in each column are staggered in the manner depicted in FIG. 2*b* but in which the adjacent columns of nozzles 22 are spaced even further apart, either physically or by electronic timing delays, than shown in FIG. 4. This additional spacing provides a blank diagonal interstitial swath as the target area is printed during a first revolution of the drum 30 and, upon completion of printing after a second revolution of the drum 30, a printed pattern or image is provided with a diagonally extending "inter-stitched" boundary, which is particularly advantageous for minimizing diagonal swath banding. The helix ratio depicted in FIG. 5 is also 1:1. The image height and number of revolutions for single pass printing are not limited but follow the relationship where the number of revolutions R=(page length/swath height)+1.

The diagonal interstitial swath boundary of FIG. 5 is analogous to printmode methods used in scanning printers, particularly in multi-pass printmodes. Drops fired from each nozzle typically have characteristic drop placement errors, shapes and sizes and these tend to vary across the printhead. By "randomizing" to some degree which nozzles fire into each row, column or line segment, the errors are less perceptible to human observers. In other words, printed dot characteristics cause patterns that human observers perceive as banding, but by breaking up these patterns with multi-pass or interstitial printing, the banding can be reduced.

Figure 6:
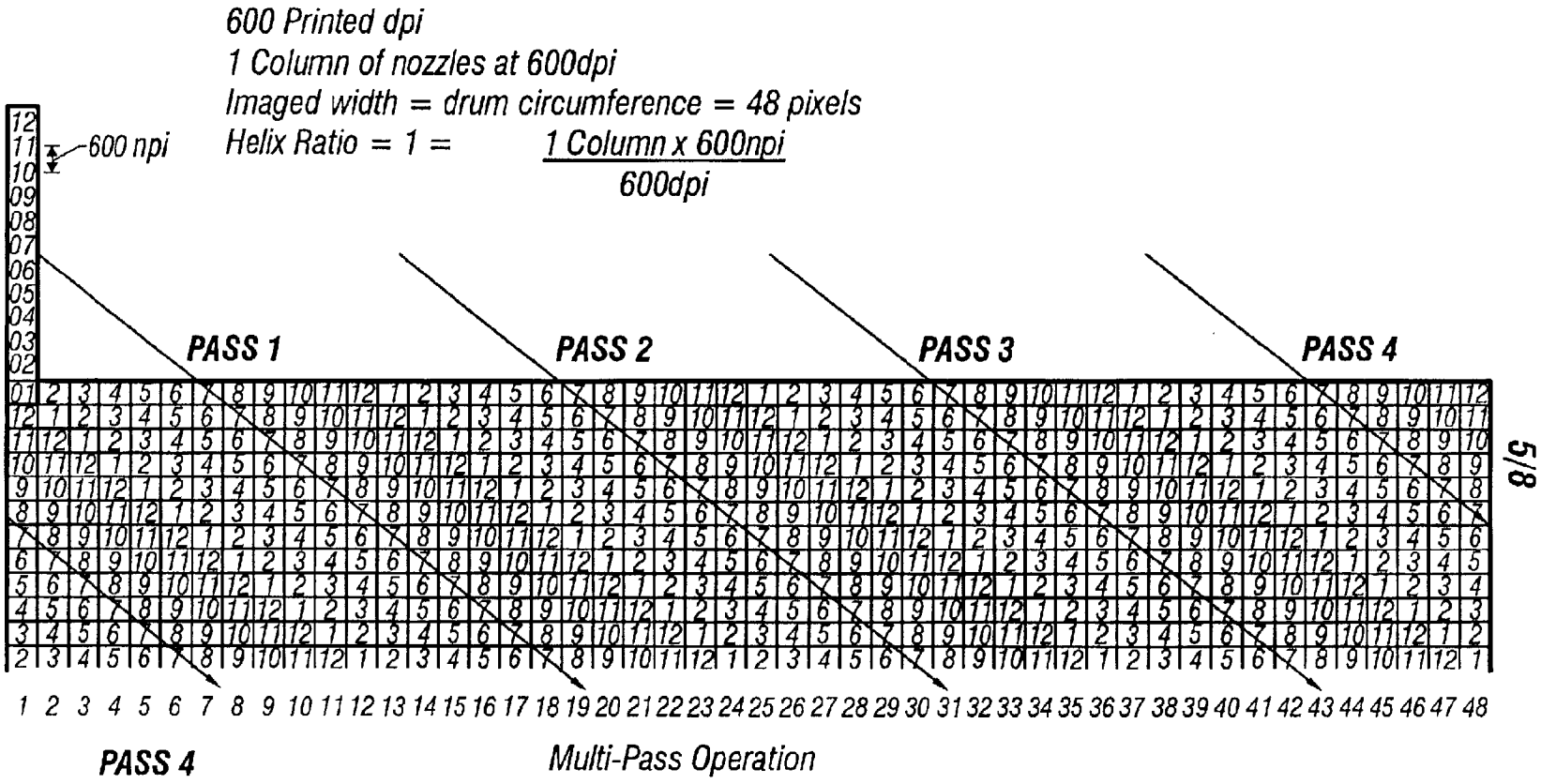
FIG. 6 is a printed pattern or mask according to another embodiment of the invention which may be produced by nozzles in a single column of nozzles in multi-pass printing.

FIG. 6 is an example of printing which requires multiple passes of the carriage to complete printing. The arrangement uses a single column, again depicted with 12 nozzles 22, which may have a density 600 npi to print an image on a target grid which is 48×12 targets or pixels in size at a resolution of 600 dpi. Note that the image height (number of rows) is limited only by the axial length of the drum 30 and the associated carriage 12 and guide 14. In this example, due to the more numerous pixels, four rotations of the drum 30 are required to address every target pixel around the circumference of the drum 30. Each pass of the printhead or printheads 20 relative to the drum 30 requires the printhead 20 to be returned in a non-printing mode back to its original position before starting the next printing pass through the print zone. This requires additional drum rotations to allow time for proper repositioning of the printhead 20. The helix ratio is 1:1.

The various print masks shown in FIGS. 3–6 all depict print targets or pixels positioned at a center-to-center X direction spacing which is equivalent to the effective center-to-center spacing or density pnpi in the Y direction of the printhead nozzles 22 and, with the exception of the multi-pass arrangement of FIG. 6, demonstrates that for a single-pass arrangement the effective number of printhead nozzles is equal to the number of targets or pixels around the drum 30 or equivalent arcuate surface. In all of these figures only a few nozzles 22 and targets are shown for clarity of illustration. Printing speeds may be enhanced when the effective density or number of printhead nozzles per inch (pnpi) in the Y direction is an integral multiple—such as two, three or four or more times—of the target density in the X direction in dpi. Stated differently, the center-to-center spacing of the targets in the direction X is at least one and preferably a multiple of the effective center-to-center spacing or density pnpi of the nozzles in the direction Y.

Figure 7:
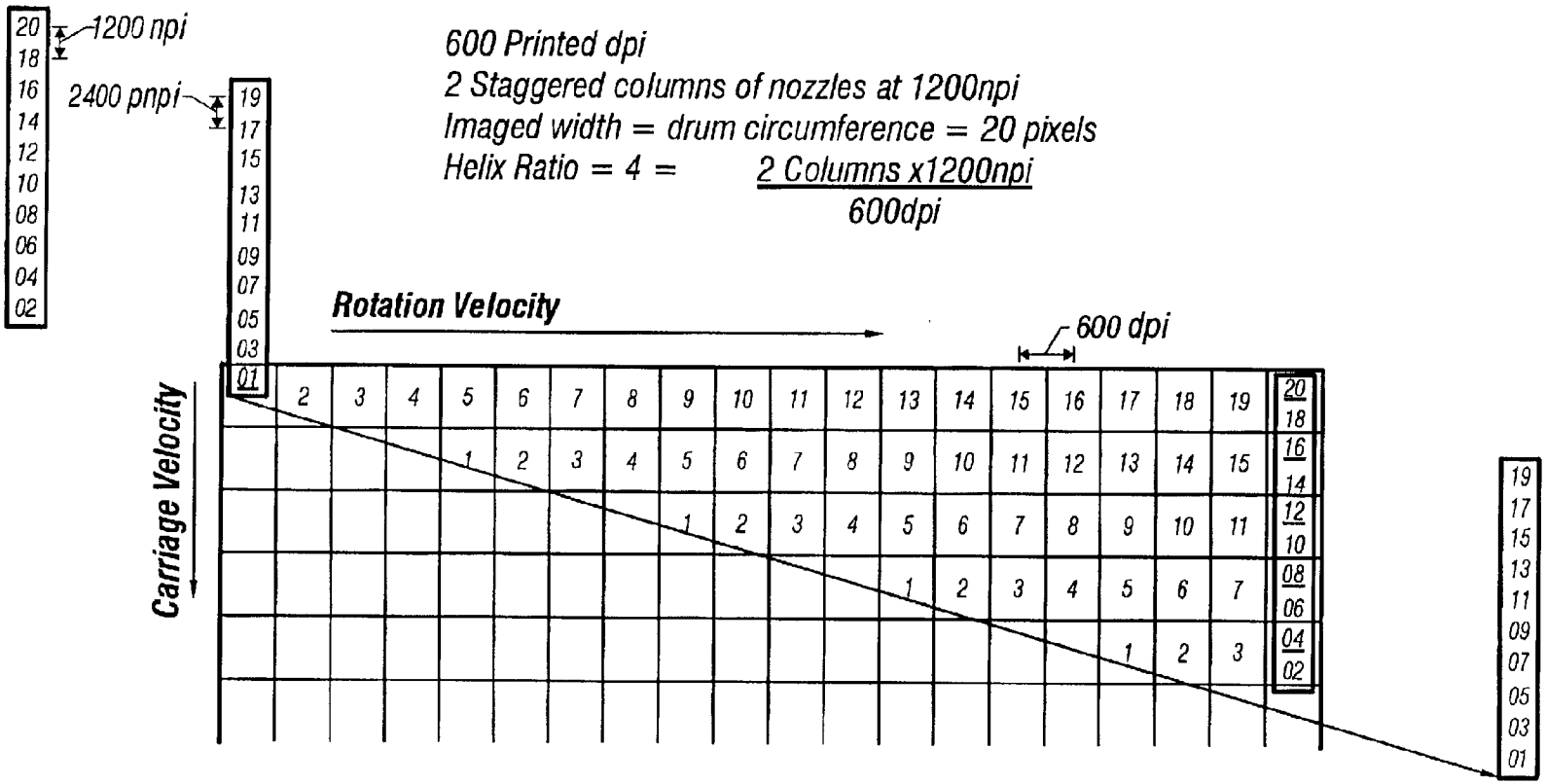
FIG. 7 is a printed pattern or mask according to another embodiment of the invention which may be produced by nozzles staggered in two spaced columns.

FIG. 7 depicts an example in which the printhead nozzles 22 are spaced such that a pair of nozzles in a column fit into a single target or pixel. In this example, each column of 10 nozzles has a density of 1200 npi but with the two columns giving an effective density of 2400 pnpi for printing 20 target pixels at a print resolution of 600 dpi. Because of the redundancy, any one of four nozzles 22 can eject a droplet of fluid onto a target pixel while others refill with fluid, allowing the drum 30 to spin at four times the speed to which it would be limited by the maximum sustainable firing frequency of a single nozzle. In FIG. 7, the helix ratio is 4:1, i.e., the drum speed is four times the printhead speed. In this example, each nozzle will print into every fourth pixel around the drum circumference at up to its maximum firing frequency. The nozzles in the individual columns can be staggered or aligned in the X direction and those skilled in the art will also understand that nozzles can be arranged in a multitude of configurations and used in conjunction with different printmodes via appropriate electronic timing adjustments.

Figure 8A:
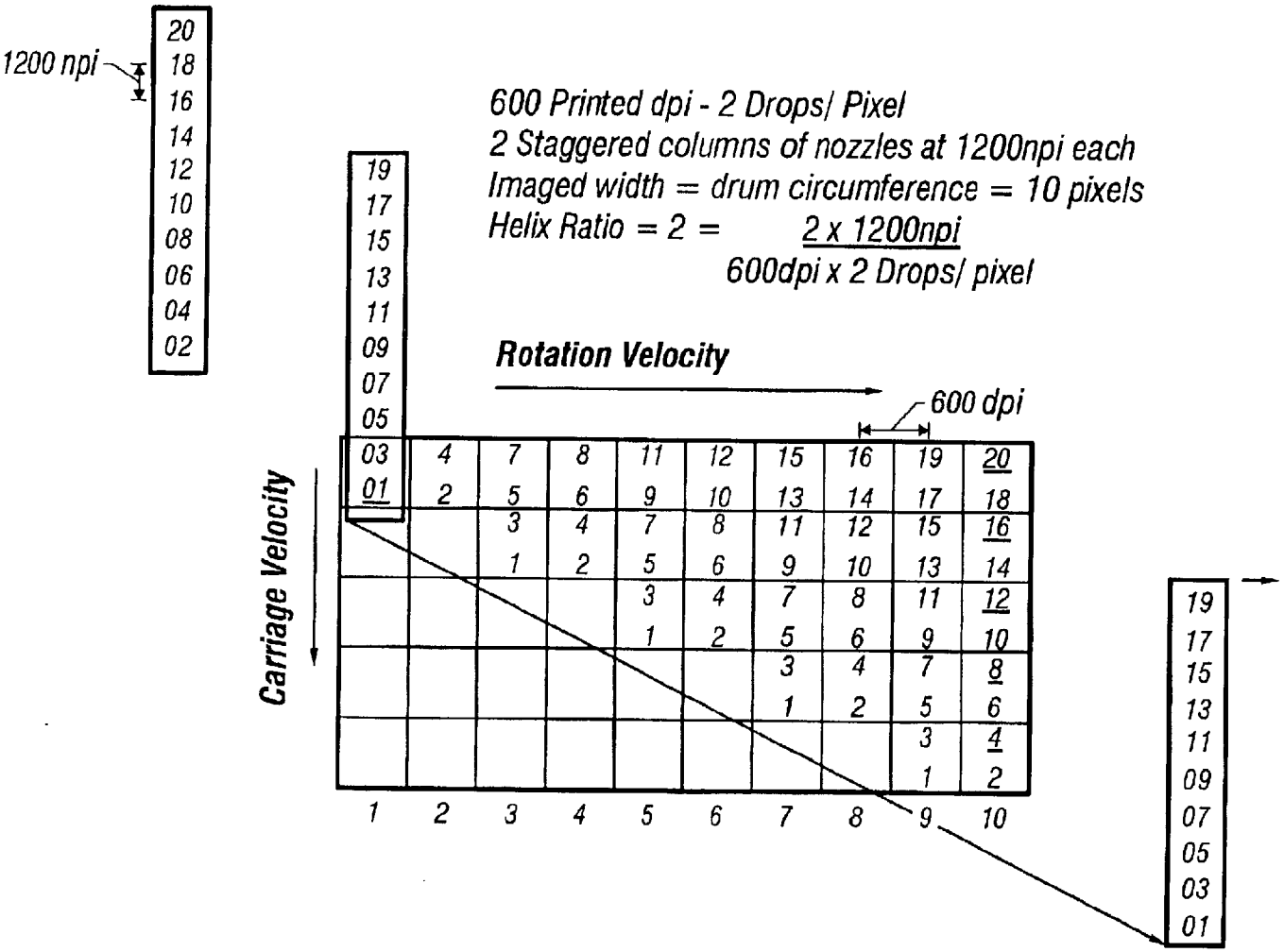
FIG. 8 is a printed pattern or mask according to another embodiment of the invention which may be produced by nozzles in two spaced columns of nozzles in which each of the target pixels may be addressed by two nozzles.
Figure 8B:
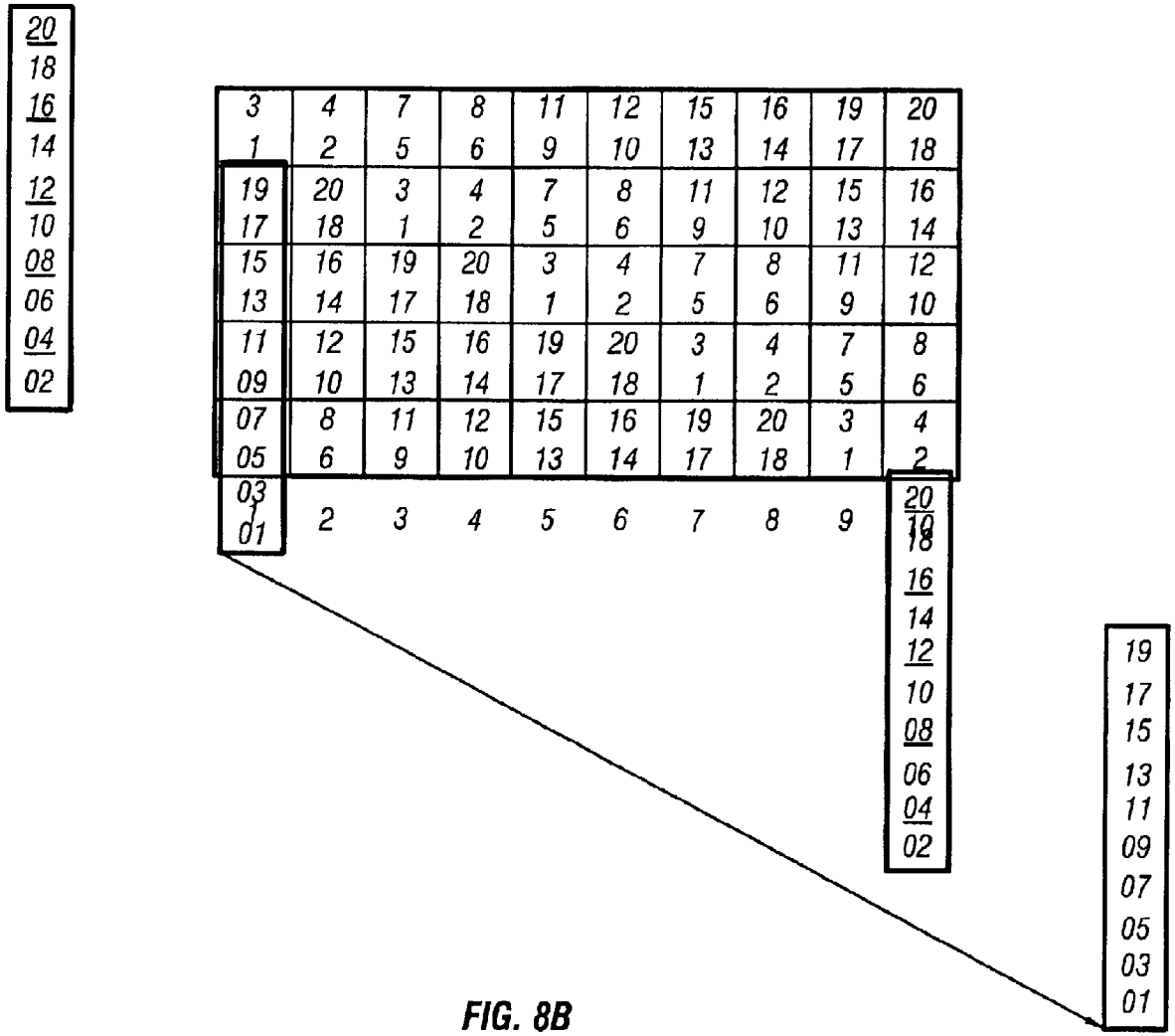

FIG. 8 shows another example of a printed pattern or mask in which the pattern or mask may be produced at a resolution of 600 dpi by two columns of 1200 npi nozzles and in which each target pixel may be addressed by two nozzles in a multi-drop per pixel manner. Note that in FIG. 8, only ten target pixels are arranged in a row whereas 20 target pixels are provided in each row in FIG. 7. In FIG. 8, the helix ratio is 2:1 (2 columns of nozzles×1200 npi in each column=2400 divided by 600 dpi×2 drops/pixel). The image width is halved because the use of effective printhead nozzle density of 2400 pnpi for producing 600 dpi resolution enables half of the nozzles to be used for high throughput and half for multi-drop printing. This technique requires the target velocity in FIG. 8 to be half that in FIG. 7, i.e., the drum 30 in FIG. 8 must turn half as fast as the drum in FIG. 7.

Although only a single printhead 20 is depicted in FIGS. 3–8, a plurality of separate printheads will ordinarily be mounted on a single carriage 12. The various printheads may contain fluid of different types such as ink of different colors or other fluids used in printing such as surface conditioning or ink droplet fixer fluids. Printer electronics, either in hardware or firmware, can readily be designed by those skilled in the art to appropriately time the firing of individual nozzles 22 on the printhead or printheads 20 to produce the desired image or pattern.

Placement of fluid droplets in a desired pattern onto media using the techniques described above are not necessarily limited to use of a single drum 30 as the media support as depicted. Images can be rapidly printed using these techniques onto cut sheet media or, particularly in offset printing, onto media in rollfeed form. The media can be supported on belts trained around multiple rollers, drums or other supports so long as one support has an arcuate surface past which the fluid ejection nozzles are moved through a printing zone in a direction having a component parallel to the axis of the arcuate surface.

The various techniques described herein have one or more of the following advantages as compared with printing techniques previously employed:

1. Higher throughput than scanning and prior rotary printers.

2. Lower cost than inkjet page wide array printers.

3. Printing speeds are limited primarily only by the maximum sustainable firing frequency of the individual printhead nozzles and not by the scanning mechanisms.

4. Complex electronic nozzle timing and other corrections for swath or media skewing as in prior rotary printers are minimized.

Persons skilled in the art will also appreciate that various additional modifications can be made in the preferred embodiment shown and described above and that the scope of protection is limited only by the wording of the claims which follow.

What is claimed is:

1. A method of placing fluid droplets onto a surface comprising:

substantially aligning a group of nozzles with a first of parallel line segments on a surface moving in a first direction relative to the nozzles;

moving the group of nozzles in a second direction having a component orthogonal to the first direction to respectively align first and second nozzles in the group with a second segment and with the first segment;

arranging the nozzles in the group in a column, including arranging the nozzles in parallel columns, and staggering the nozzles in said columns to provide an effective printhead nozzle density which is a multiple of the density of nozzles in each column;

ciccting droplets from the nozzles onto targets on the segments; and spacing adjacent nozzles in the group at a distance less than a minimum spacing between axially adjacent segments.

2. The method of claim 1, wherein the nozzles and the surface are relatively moved in orthogonally related axial arid arcuate directions.

3. The method of claim 1, comprising arranging the nozzles in groups in which the number of nozzles in each group is equal to a total number of targets in a segment.

4. The method of claim 2, comprising ejecting fluid onto all selected targets in a single pass of the nozzles relative to the surface.

5. The method of claim 2, wherein the surface is on media to be printed, including mounting the media on an exterior surface of a cylindrical support.

6. The method of claim 5, comprising rotating the support and moving the nozzles axially of the support during printing.

7. The method of claim 1, comprising ejecting single drops of ink onto selected targets.

8. A method of inkjet printing on a cylindrical surface, comprising:

rotating the cylindrical surface about a rotational axis at a rotational velocity; and scanning an arrangement of nozzles over the cylindrical surface in along a scanning axis at a scanning velocity, the scanning axis having a direction substantially parallel to the rotational axis;

wherein the arrangement of nozzles includes two columns of nozzles each having a column axis substantially parallel to the scanning axis, the nozzles in each column further having a substantially identical center-to-center spacing along the column axis, the columns staggered from each other in the scanning direction by out-half the center-to-center spacing, such that the effective nozzle density is twice the center-to-center spacing, wherein the arrangement of nozzles includes a single column of nozzles having a column axis substantially parallel to the scanning axis, the nozzles further having a center-to-center spacing along the column axis, the center to center spacing defining the effective nozzle density, wherein the effective nozzle density is at least 2 to 8 times the print density.

9. The method of claim 8, wherein the ejecting includes operating the nozzles at a maximum sustainable firing frequency during the rotating and scanning.

10. The method of claim 8, wherein a print density from the arrangement of nozzles is equal to a number of pixel locations around the circumference of the cylindrical surface orthogonal to said rotational axis.

11. The method of claim 10, wherein the arrangement of nozzles includes N nozzles, where N is equal to the number of pixel locations around the circumference divided by the number of times scanning is performed to fully print the pattern.

* * * * *

UNITED STATES PATENT AND TRADEMARK OFFICE

CERTIFICATE OF CORRECTION

PATENT NO. : 6,814,425 B2
DATED : November 9, 2004
INVENTOR(S) : James A. Mott et al.

It is certified that error appears in the above-identified patent and that said Letters Patent is hereby corrected as shown below:

Column 7,
Line 21, delete “ciccting” and insert therefor -- ejecting --.

Column 8,
Line 18, delete “out-half” and insert therefor -- one-half --.
Line 40, please add the following claim:
-- 12. A method of inkjet printing on a cylindrical surface, comprising:

rotating the cylindrical surface about a rotational axis at a rotational velocity; and scanning an arrangement of nozzles over the cylindrical surface in along a scanning axis at a scanning velocity, the scanning axis having a direction subtantially parallel to the rotational axis;

wherein the arrangement of nozzles includes two columns of nozzles each having a column axis substantially parallel to the scanning axis, the nozzles in each column further having a substantially identical center-to-center spacing along the column axis, the columns staggered from each other in the scanning direction by one-half the center-to-center spacing, such that the effective nozzle density is twice the center-to-center spacing, wherein the arrangement of nozzles includes a single column of nozzles having a column axis substantially parallel to the scanning axis, the nozzles further having a center-to-center spacing along the column axis, the center to center spacing defining the effective nozzle density, wherein the effective nozzle density is at least 4 to 8 times the print density. --.

Signed and Sealed this

Twenty-ninth Day of November, 2005

JON W. DUDAS
*Director of the United States Patent and Trademark Office*